US009130281B2

(12) United States Patent
Phillips, Jr. et al.

(10) Patent No.: US 9,130,281 B2
(45) Date of Patent: Sep. 8, 2015

(54) POST ASSEMBLY FOR COAXIAL CABLE CONNECTORS

(71) Applicant: PPC Broadband, Inc., East Syracuse, NY (US)

(72) Inventors: Roger Phillips, Jr., Horseheads, NY (US); Kenneth L. Mansfield, Burdett, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 14/255,318

(22) Filed: Apr. 17, 2014

(65) Prior Publication Data

US 2014/0315448 A1 Oct. 23, 2014

Related U.S. Application Data

(60) Provisional application No. 61/812,913, filed on Apr. 17, 2013.

(51) Int. Cl.
*H01R 9/05* (2006.01)
*H01R 103/00* (2006.01)

(52) U.S. Cl.
CPC ..... *H01R 9/0524* (2013.01); *H01R 2103/00* (2013.01)

(58) Field of Classification Search
CPC ..... H01R 13/518; H01R 13/504
USPC ..... 439/578, 540.1, 534, 550, 563, 572
See application file for complete search history.

(56) References Cited

U.S. PATENT DOCUMENTS

| | | | |
|---|---|---|---|
| 1,667,485 | A | 4/1928 | Macdonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Meicher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Bonder |
| 3,091,748 | A | 5/1963 | Takes et al. |

(Continued)

FOREIGN PATENT DOCUMENTS

| | | | |
|---|---|---|---|
| EP | WO0186756 | * 11/2001 | ..... H01R 9/05 |
| EP | WO2006074357 | * 7/2006 | ..... H01R 9/05 |
| EP | WO2010135181 | * 11/2010 | ..... H01R 24/02 |

OTHER PUBLICATIONS

PCT/US14/34529; International Filing Date Apr. 17, 2014; International Search Report and Written Opinion; Date of Mailing Aug. 22, 2014; (16 pages).

*Primary Examiner* — Phuongchi T Nguyen
(74) *Attorney, Agent, or Firm* — Barclay Damon LLP

(57) ABSTRACT

A post assembly for a coaxial cable connector comprises, in one embodiment, a post configured to be coupled to a conductor of the coaxial cable. The post assembly has a post extender disposed between the post and an interface port, and a spring configured to urge the post extender toward the interface port.

20 Claims, 11 Drawing Sheets

(56) References Cited

U.S. PATENT DOCUMENTS

| | | | |
|---|---|---|---|
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston et al. |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Bruner |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,823 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenne et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChampt et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |

(56) References Cited

U.S. PATENT DOCUMENTS 4,655,534 A 4/1987 Stursa
4,660,921 A 4/1987 Hauver
4,668,043 A 5/1987 Saba et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,691,976 A 9/1987 Cowen
4,697,859 A 10/1987 Fisher, Jr.
4,703,987 A 11/1987 Gallusser et al.
4,703,988 A 11/1987 Raux et al.
4,717,355 A 1/1988 Mattis
4,734,050 A 3/1988 Negre et al.
4,734,666 A 3/1988 Ohya et al.
4,737,123 A 4/1988 Paler et al.
4,738,009 A 4/1988 Down et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday

(56) References Cited

U.S. PATENT DOCUMENTS 5,683,263 A 11/1997 Hsu
5,702,263 A 12/1997 Baumann et al.
5,722,856 A 3/1998 Fuch et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,222 B1 4/2001 Lanham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,676,446 B2 1/2004 Montena
6,683,253 B1 1/2004 Lee
6,692,285 B2 2/2004 Islam
6,712,631 B1 3/2004 Youtsey
6,716,062 B1 4/2004 Palinkas et al.
6,733,336 B1 5/2004 Montena et al.
6,733,337 B2 5/2004 Kodaira
6,767,248 B1 7/2004 Hung
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,393,245 B2 7/2008 Palinkas et al.
7,452,239 B2 11/2008 Montena
7,476,127 B1 1/2009 Wei
7,479,035 B2 1/2009 Bence et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 7/2010 Montena
7,794,275 B2 9/2010 Rodrigues
7,806,725 B1 10/2010 Chen
7,811,133 B2 10/2010 Gray
7,824,216 B2 11/2010 Purdy
7,828,595 B2 11/2010 Mathews
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam
7,892,005 B2 2/2011 Haube
7,892,024 B1 2/2011 Chen
7,927,135 B1 4/2011 Wlos
7,950,958 B2 5/2011 Mathews
7,972,175 B2 7/2011 Chawgo
8,075,337 B2 12/2011 Malloy et al.
8,113,875 B2 2/2012 Malloy et al.
2002/0013088 A1 1/2002 Rodrigues et al.
2002/0038720 A1 4/2002 Kai et al.
2003/0211778 A1 11/2003 Burris et al.
2003/0214370 A1 11/2003 Allison et al.
2004/0077215 A1 4/2004 Palinkas et al.
2004/0102089 A1 5/2004 Chee
2004/0209516 A1 10/2004 Burris et al.
2004/0219833 A1 11/2004 Burris et al.
2004/0229504 A1 11/2004 Liu
2005/0042919 A1 2/2005 Montena
2005/0208827 A1 9/2005 Burris et al.
2006/0110977 A1 5/2006 Matthews
2006/0154519 A1 7/2006 Montena
2007/0026734 A1 2/2007 Bence et al.
2007/0298654 A1 12/2007 Holliday
2008/0102696 A1 5/2008 Montena
2009/0029590 A1 1/2009 Sykes et al.
2009/0098770 A1 4/2009 Bence et al.
2010/0081321 A1 4/2010 Malloy et al.
2010/0081322 A1 4/2010 Malloy et al.

(56) References Cited

U.S. PATENT DOCUMENTS

| | | | |
|---|---|---|---|
| 2010/0105246 | A1 | 4/2010 | Burris et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2011/0021072 | A1 | 1/2011 | Purdy |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2012/0171894 | A1 | 7/2012 | Malloy et al. |

* cited by examiner

POST ASSEMBLY FOR COAXIAL CABLE CONNECTORS

PRIORITY CLAIM

This application is a non-provisional of, claims the benefit and priority of, U.S. Provisional Patent Application No. 61/812,913, filed on Apr. 17, 2013. The entire contents of such application are hereby incorporated by reference.

BACKGROUND

Connectors for coaxial cables typically connect complementary interface ports to electrically integrate coaxial cables to various electronic devices. It is desirable to maintain electrical continuity through a coaxial cable connector to prevent radio frequency (RF) leakage and ensure a stable ground connection. A connector typically employs a threaded nut to effect the requisite electrical connection between a grounded post and a threaded interface port. More specifically, as the threaded nut is torqued/tightened onto the threads of the port, the face surfaces of the post and port are brought into abutting contact to establish and maintain electrical continuity.

Oftentimes, due to user failure or periodic forces or movement directed toward the connector, the threaded nut backs away from the port, resulting in RF leakage and signal interference. In designs which use the threaded nut as a ground path, either in addition to or in lieu of the ground path created by contact between the post and port, the nut can inadvertently create a path for the ingress or egress of RF energy. When the nut is not fully tightened onto the port, an impedance mismatch can occur adversely affecting signal performance. As a consequence, the nut that is not fully tightened onto the port, poses a problem for maintaining RF signal performance and electrical continuity between the interface port and the post.

Therefore, there is a need to overcome, or otherwise lessen the effects of, the disadvantages and shortcomings described above.

SUMMARY

In one embodiment, a post assembly is provided for a coaxial cable connector comprising a post configured to be coupled to a conductor of the coaxial cable. The post assembly has a post extender disposed between the post and an interface port, and a spring configured to urge the post extender toward the interface port. The post extender is configured to move axially relative to the post and cooperates with the spring to maintain an electrical ground path from the post to the interface port.

Additional features and advantages of the present disclosure are described in, and will be apparent from, the following Brief Description of the Drawings and Detailed Description.

DETAILED DESCRIPTION

Network and Interfaces

Figure 1:
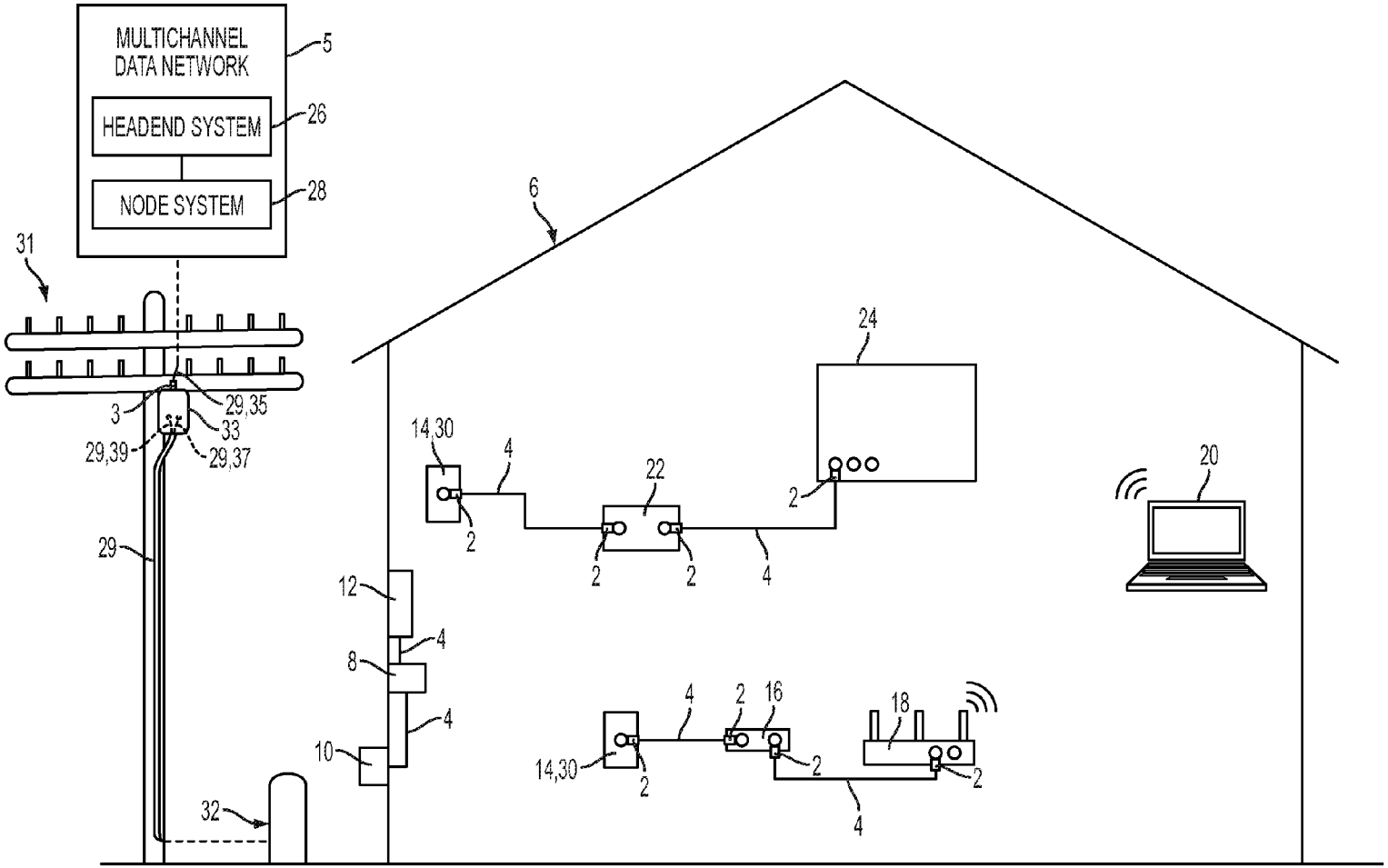
FIG. 1 is a schematic diagram illustrating an environment coupled to a multichannel data network.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals.

In one embodiment, a drop line coaxial cable or weather-protected or weatherized coaxial cable 29 is connected to the headend system 26 or node system 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or male-type connector 3. The entry junction box device 33 also includes a plurality of output data ports within its weatherized housing. It should be appreciated that such a junction device can include any suitable number of input data ports and output data ports.

The end of the weatherized coaxial cable 35 is attached to a hardline connector or male-type connector 3. The ends of the weatherized coaxial cables 37 and 39 are each attached to one of the female-type connectors 2 described below. In this way, the connectors 2 and 3 electrically couple the cables 35, 37 and 39 to the junction device 33.

In one embodiment, the male-type connector 3 has a male shape which is insertable into the applicable female input tap or female input data port of the junction device 33. The two output ports of the junction device 33 are male-shaped, and the female-type connectors 2 receive, and connect to, such male-shaped output data ports.

In one embodiment, each input tap or input data port of the entry junction device 33 has an internally threaded wall configured to be threadably engaged with one of the male-type connectors 3. The network 5 is operable to distribute signals through the weatherized coaxial cable 35 to the junction device 33, and then through the male-type connector 3. The junction device 33 splits the signals to the two female-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners and signal splitters; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top unit 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles.

As described above, the data service provider uses coaxial cables 29 and 4 to distribute the data to the environment 6. The environment 6 has an array of coaxial cables 4 at different locations. The female-type connectors 2 are attachable to the coaxial cables 4. The cables 4, through use of the female-type connectors 2, are connectable to various communication interfaces within the environment 6, such as the male interface ports 14 illustrated in FIGS. 1-2. In the examples shown, male interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
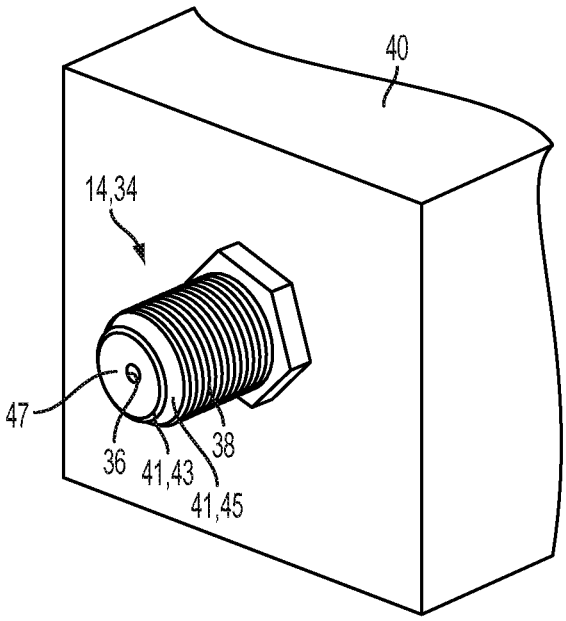
FIG. 2 is an isometric view of one embodiment of an interface port which is configured to be operatively coupled to the multichannel data network.
Figure 4:
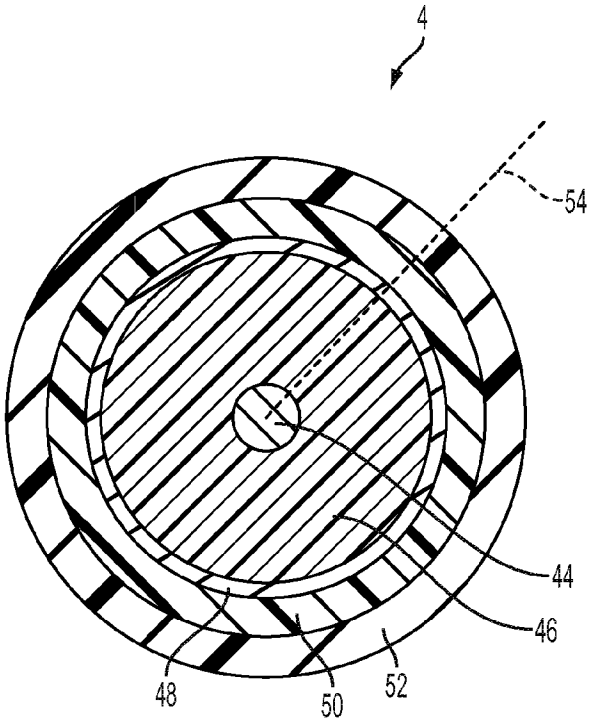
FIG. 4 is a cross-sectional view of the cable, taken substantially along line 4-4 of FIG. 3.

In one embodiment, each of the male interface ports 14 includes a stud or male jack, such as the male interface port 34 illustrated in FIG. 2. The male stud 34 has: (a) an inner, cylindrical wall 36 defining a central hole configured to receive an electrical contact, wire or conductor (not shown) positioned within the central hole; (b) a conductive, threaded outer surface 38; (c) a conical conductive region 41 having conductive contact sections 43 and 45; and (d) a dielectric or insulation material 47.

In one embodiment, male interface port 34 is shaped and sized to be compatible with the F-type coaxial connection standard. Alternately, the male interface port 34 may be configured to be compatible with a BNC connector, SMA connector, N male connector, N female connector, UHF connector, DIN connectors, a push-on connector, push-on F connector, or similar coaxial cable connector. It should be understood that, depending upon the embodiment, the male interface port 34 could have a smooth outer surface. The male interface port 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the female-type connector 2 onto the male interface port 34. Once installed, the female-type connector 2 receives the male interface port 34. The female-type connector 2 establishes an electrical connection between the cable 4 and the electrical contact of the male interface port 34.

After installation, the connectors 2 often undergo various forces. For example, there may be tension in the cable 4 as it stretches from one device 40 to another device 40, imposing a steady, tensile load on the female-type connector 2. A user might occasionally move, pull or push on a cable 4 from time to time, causing forces on the female-type connector 2. Alternatively, a user might swivel or shift the position of a TV 24, causing bending loads on the female-type connector 2. As described below, the female-type connector 2 is structured to maintain a suitable level of electrical connectivity despite such forces.

Cable

Referring to FIGS. 3-6, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 3:
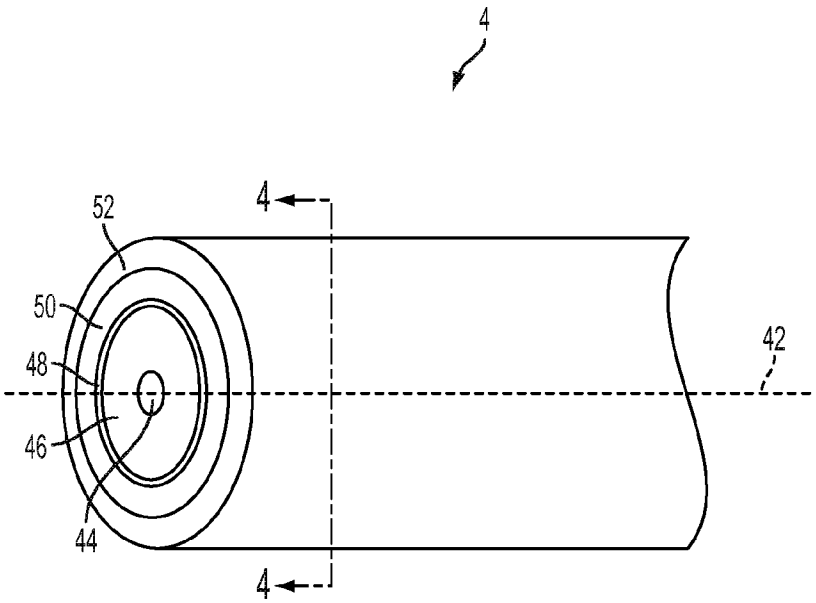
FIG. 3 is a broken-away isometric view of one embodiment of a cable which is configured to be operatively coupled to the multichannel data network.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the female-type connector 2 electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In such embodiment, the cable 4 has two electrical grounding paths. The first grounding path runs from the inner conductor 44 to ground. The second grounding path runs from the outer conductor 50 to ground.

The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the outer jacket 52 has a protective characteristic, guarding the cable's internal components from damage. The outer jacket 52 also has an electrical insulation characteristic. In one embodiment, the outer jacket 52 is compressible along the radial line 54 and is flexible along the longitudinal axis 42. The outer jacket 52 is constructed of a suitable, flexible material such as polyvinyl chloride (PVC) or rubber. In one embodiment, the outer jacket 52 has a lead-free formulation including black-colored PVC and a sunlight resistant additive or sunlight resistant chemical structure.

Figure 5:
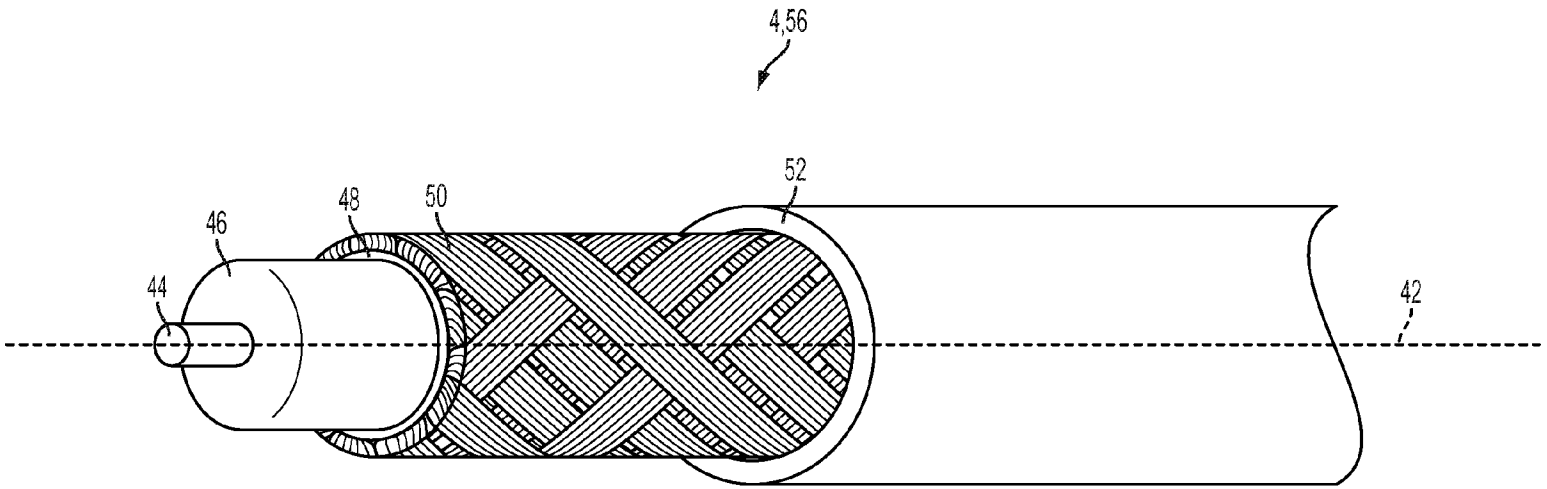
FIG. 5 is a broken-away isometric view of one embodiment of a cable which is configured to be operatively coupled to the multichannel data network, illustrating a three-stepped configuration of a prepared end of the cable.
Figure 6:
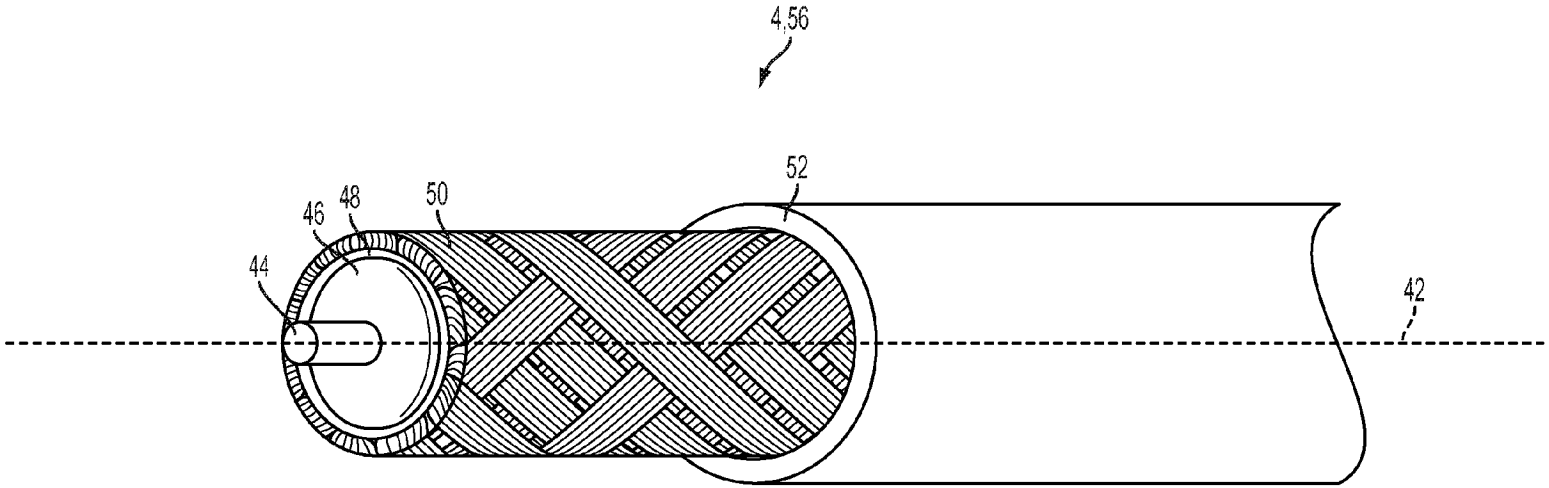
FIG. 6 is a broken-away isometric view of one embodiment of a cable which is configured to be operatively coupled to the multichannel data network, illustrating a two-stepped configuration of a prepared end of the cable.

Referring to FIGS. 5-6, in one embodiment an installer or preparer prepares a terminal end 56 of the cable 4 so that it can be mechanically connected to the female-type connector 2. To do so, the preparer removes or strips away differently sized portions of the outer jacket 52, outer conductor 50, foil layer 48 and insulator 46 so as to expose the side walls of the outer jacket 52, outer conductor 50, foil layer 48 and insulator 46 in a stepped or staggered fashion. In the example shown in FIG. 5, the prepared end 56 has a three step-shaped configuration. In the example shown in FIG. 6, the prepared end 58 has a two step-shaped configuration. The preparer can use cable preparation pliers or a cable stripping tool to remove such portions of the cable 4. At this point, the cable 4 is ready to be connected to the female-type connector 2.

Figure 7:
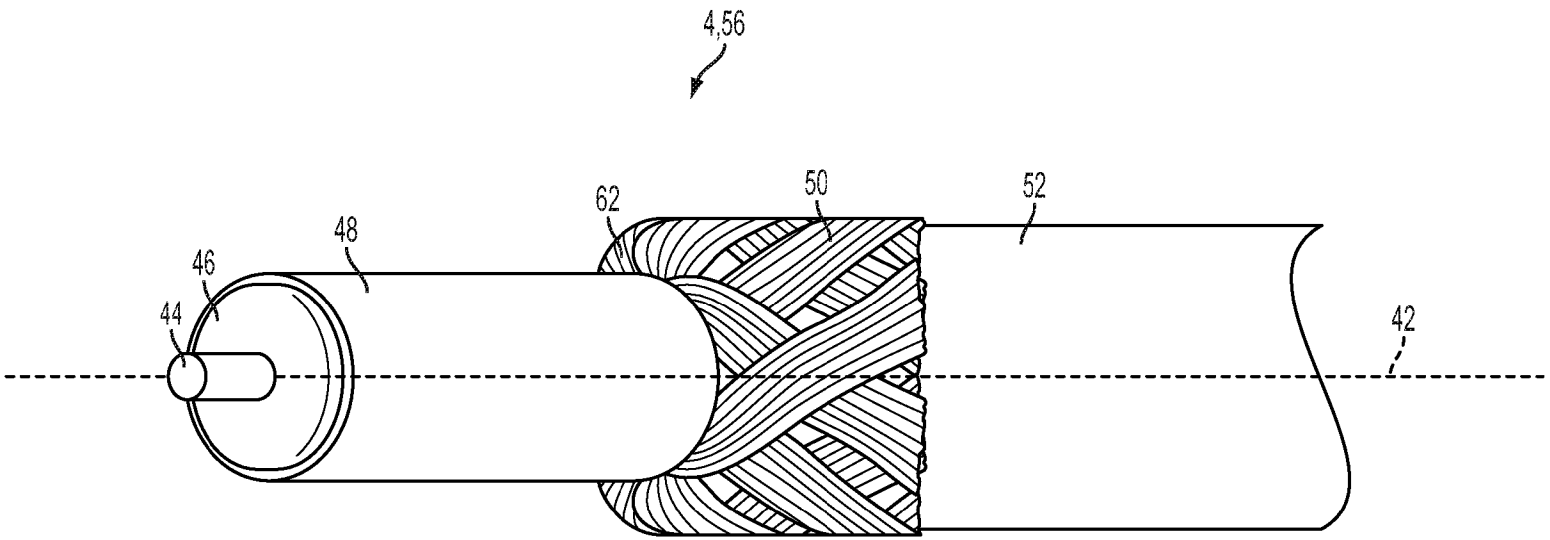
FIG. 7 is a broken-away isometric view of one embodiment of a cable which is configured to be operatively coupled to the multichannel data network, illustrating the folded-back, braided outer conductor of a prepared end of the cable.

In one embodiment illustrated in FIG. 7, the installer or preparer performs a folding process to prepare the cable 4 for connection to female-type connector 2. In the example illustrated, the preparer folds the braided outer conductor 50 backward onto the outer jacket 52. As a result, the folded section 60 is oriented inside out. The bend or fold 62 is adjacent to the foil layer 48 as shown. Certain embodiments of the female-type connector 2 employ include a tubular post. In such embodiments, the folding process facilitates the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the outer jacket 52 can vary based upon parameters corresponding to broadband communication standards or installation equipment.

Figure 8:
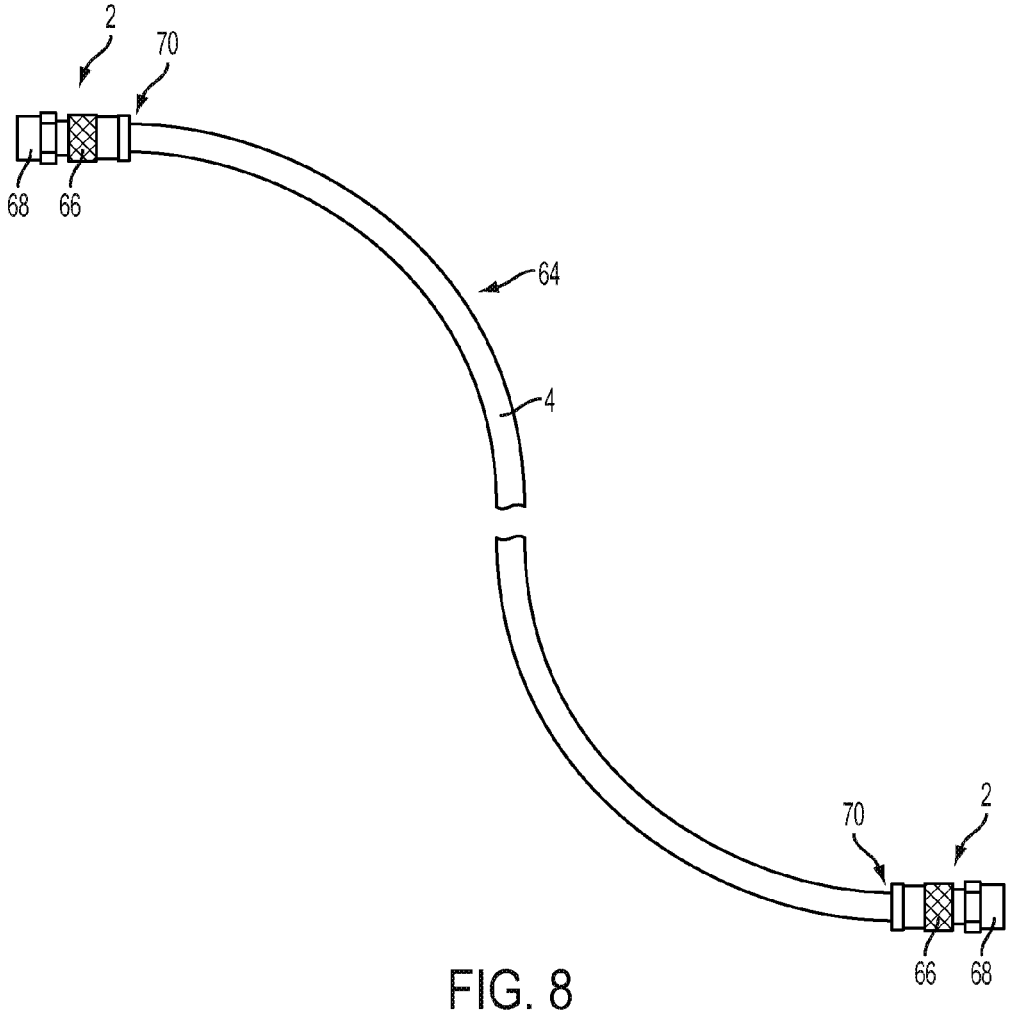
FIG. 8 is a top view of one embodiment of a cable jumper or cable assembly which is configured to be operatively coupled to the multichannel data network.

In one embodiment illustrated in FIG. 8, a cable jumper or cable assembly 64 includes a combination of the female-type connector 2 and the cable 4 attached to the female-type connector 2. In this embodiment, the female-type connector 2 includes: (a) a connector body or connector housing 66; and (b) a fastener or coupler 68, such as a threaded nut, which is rotatably coupled to the connector housing 66. The cable assembly 64 has, in one embodiment, connectors 2 on both of its ends 70. Preassembled cable jumpers or cable assemblies 64 can facilitate the installation of cables 4 for various purposes.

In one embodiment the weatherized coaxial cable 29, illustrated in FIG. 1, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

Connector and Post Assembly

As mentioned in the preceding paragraphs, it is desirable to electrically shield the internal RF signal, i.e., the signal carried by the inner conductor 44, to prevent ingress and/or egress of RF energy into or from the coaxial cable 4. Proper shielding abates interference from neighboring RF networks and prevents cross-talk with other RF signals. Such shielding is commonly effected by a conductive sheathing, web or braided material over the signal carrying conductor, and the shielding material is electrically grounded to carry the interfering or stray RF energy away from the signal-carrying conductor. A break, gap or passage which allows RF energy to escape can result in leakage which can be harmful to other networks and communication systems. For example, RF leakage from an RF device can distort or degrade the television image of a cable network subscriber located in close proximity to the source of the RF leakage. In yet another example, the collective RF leakage emanating from the set-top boxes of a residential high-rise building can create hazards to commercial aircraft flying over the building. The source of RF leakage in the building may be a collection of loose fitting connections between the set-top boxes and the respective coaxial cable. If the RF levels are too high, the responsible governmental authorities, e.g., the Federal Aviation Authority (FAA), can impose large monetary fines against the responsible service provider. Such fines may continue until the service provider remedies the problem by properly shielding the RF devices.

Figure 9:
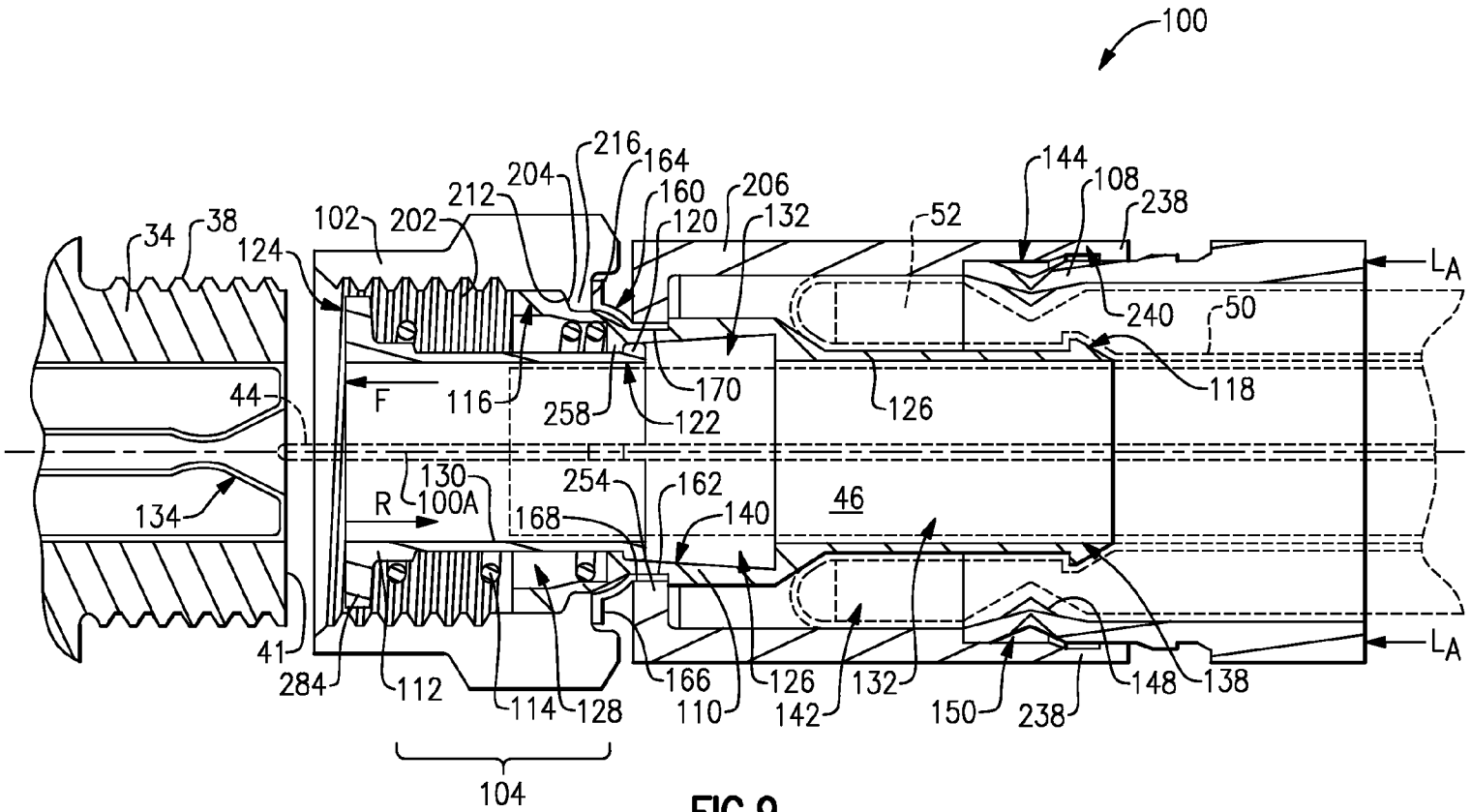
FIG. 9 depicts a cross-sectional view of an embodiment of a post assembly for a coaxial cable connector including a post, a post extender and a biasing spring element disposed between the post and the post extender.

The connector 100 of the present disclosure remedies a loose connection between the interface port 34 and the coaxial cable 4 by maintaining the electrical ground path irrespective of axial separation occurring between the connector 100 and the interface port 34. FIG. 9 depicts an embodiment of a connector 100 for coupling the coaxial cable 4 to the interface port 34. In the described embodiment, the connector 100 maintains grounding contact with the outer conductor 50 of the coaxial cable 4 independent of axial separation and/or angular misalignment of the interface port relative to the connector 100. The following paragraphs briefly describe the principal elements of the connector 100 and the structural/functional interaction between the elements. Thereafter, each element will be described in greater detail.

Figure 13:
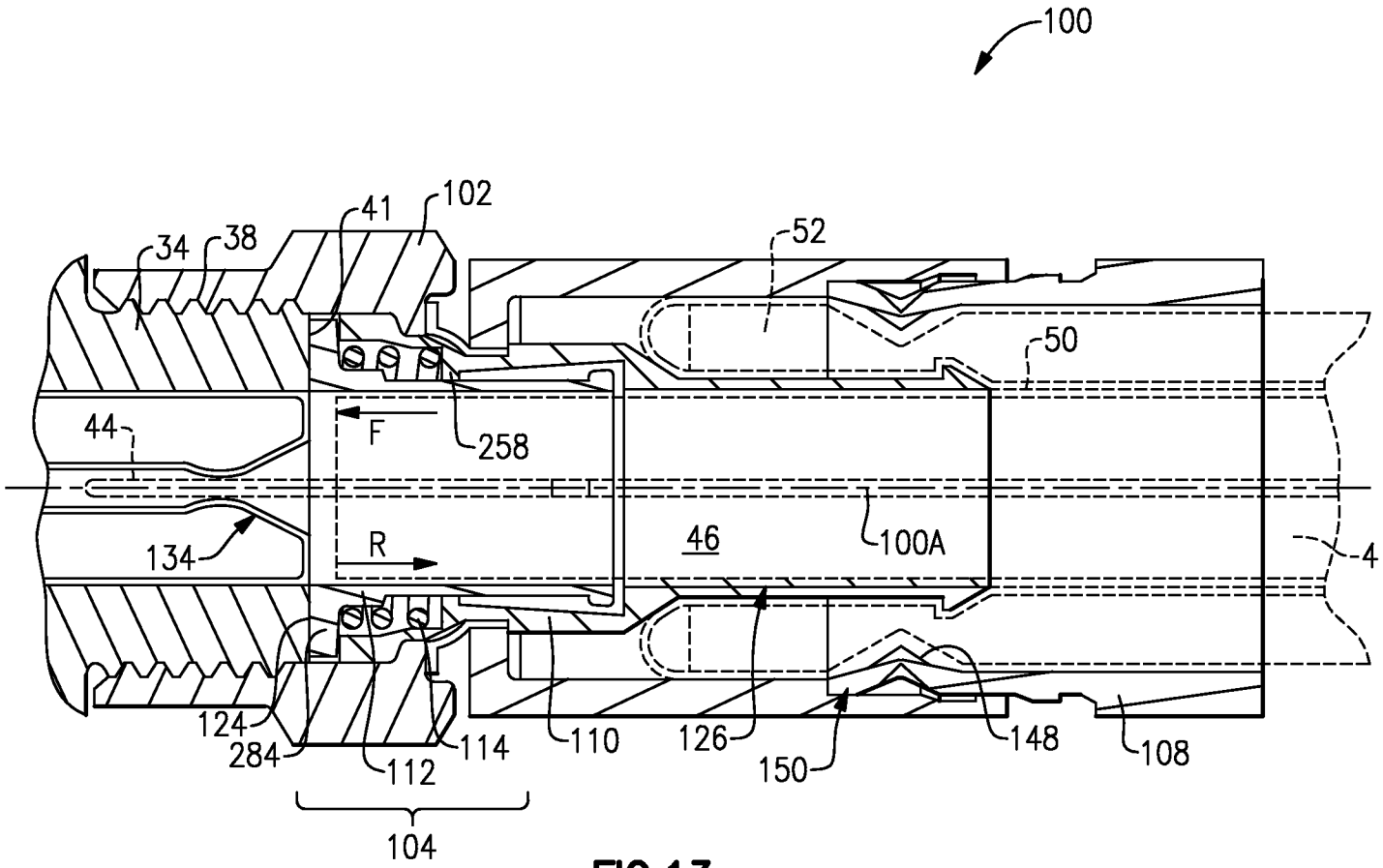
FIG. 13 a cross-sectional view of one embodiment of the coaxial cable connector engaging a threaded interface port wherein a threaded coupler/nut is fully torqued/tightened onto the threads of the interface port.
Figure 14:
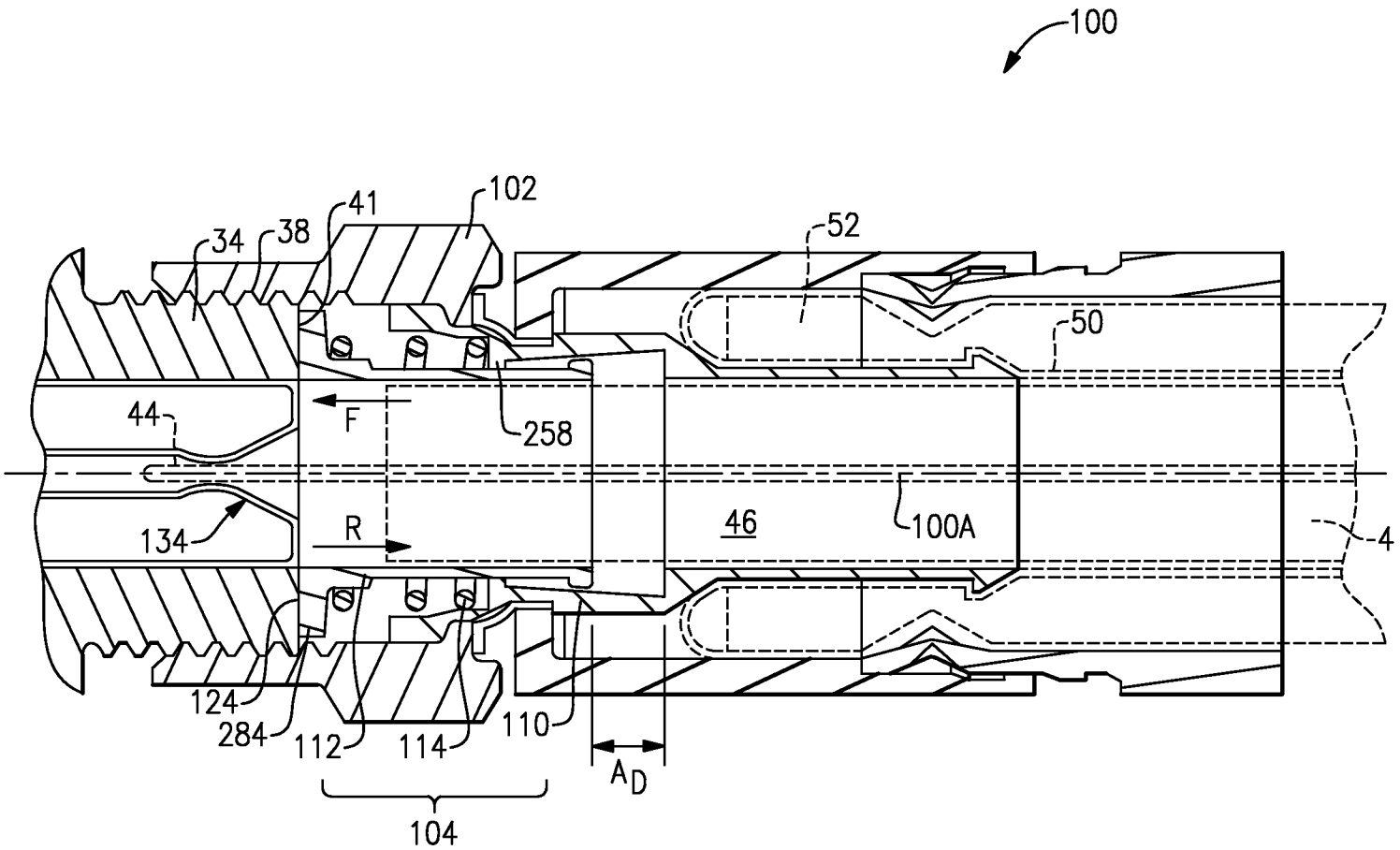
FIG. 14 depicts the cross-sectional view shown in FIG. 13 wherein the threaded coupler/nut rotates several revolutions from a fully-tightened position and wherein the post extender is axially displaced away from the post to remain engaged with a face surface of the interface port.

The connector 100 includes a coupler 102, a post assembly 104, a connector body 106, and a compression member or fastener 108. The post assembly 104 further comprises a post 110, a post extender 112, and a spring or biasing element 114. The coupler 102 connects a forward end or lip 116 of the post 110 to the interface port 34 and pre-compresses or urges the post extender 112 against the spring or biasing element 114. That is, as the coupler 102 is tightened over the threads 38 of the interface port 34, a face surface 41 of the interface port 34 abuts and compresses the post extender 112 against the biasing element 114. The figures depict various conditions or states of the connector 100 as they relate to the effectiveness of the coupler 102 to produce an adequate ground and/or minimize RF leakage. For example, in FIG. 9, the spring or biasing element 114 is unloaded or fully decompressed and the post extender 112 is fully extended, i.e., not retracted by tightening the coupler 102 against the threads of the interface port 34. In FIG. 13, the biasing element 114 is fully pre-compressed such that the coupler 102 brings the interface port 34 tightly against the post extender 112. In FIG. 14, the coupler 102 is partially tightened, leaving a gap between the interface port 34 and the forward lip 116 of the post 110. The significance of each will become clear when discussing the function and operation of the post assembly 104 within the connector 100.

The post assembly 104 (i) extends along an elongate axis 100A between the coupler 102 and the connector body 106, (ii) is coupled to the outer conductor 50 of the coaxial cable 4, and (iii) produces an electrical ground path from the outer conductor 50 to the interface port 34. With respect to the latter, the RF energy initially passes from the outer conductor 50 to a rearward end 118 of the post 110. In one embodiment, the RF energy then travels through the conductive biasing element 114 to the post extender 112. Alternatively, the RF energy may pass directly to the post extender 112 through one or more outwardly projecting rearward protrusions 120 of the post extender 112. The protrusions 120 extend from one or more arcuate edges 122 of the post extender 112. Finally, the RF energy passes from a forward face 124 of the post extender 112 to the face or conductive region 41 of the interface port 34.

The post 110 defines a bore or aperture 126 for receiving one of: (i) the spring or biasing element 114, (ii) the post extender 112, and (iii) the coaxial cable 4. A first cavity 128 receives a cylindrical body 130 of the post extender 112 while a second cavity 132 receives the spring or biasing element 114 of the extender 112. The cylindrical body 130, furthermore, is axially retained within the post 110 by the rearward protrusions 120 of the post extender 112. Finally, the aperture 126 also receives the coaxial cable 4 and allows a conductor engager 134 of the interface port 34 to receive the inner conductor 44.

The post extender 112 is disposed along the elongate axis 100A, between the post 110 and the face 41 of the interface port 34, and is configured to move axially along the axis 110A or telescope relative to the post 110. More specifically, the cylindrical body 130 of the extender 112 telescopes within the first and second cavities 128, 132 of the post 110 while the rearward protrusions 120 retain the cylindrical body 130 within the second cavity 132 of the post 110. Furthermore, the post extender 112 slides within the cavities 128, 132 and cooperates with the biasing element 114 to produce an electrical ground path from the post 110 to the interface port 34.

The connector body 106 connects to a medial portion 140 of the post 110 and defines an annular cavity 142 together with the rearward end 118 of the post 110. The annular cavity 142 receives the folded end portion of the outer conductor 50 as an annular barb 138 of the post 110 is forcibly inserted between the inner dielectric material 46 of the coaxial cable 4 and the outer conductor 50.

The compression member or fastener 108 engages a rearward end 144 of the connector body 106 to compress the outer conductor 50 and jacket 52 of the coaxial cable 4 against the annular barb 138 of the post 110. More specifically, the compression member or fastener 108 includes a deformable bellows ring 148 at the forward end 150 of the fastener 108 which is axially aligned with the annular barb 138. The bellows ring 148 may also be positioned immediately forward of the barb 138 as shown in FIG. 9.

With the deformable bellows ring 148 positioned relative to the barb 138, the compression member or fastener 108 is subject to an axial load $L_A$ which deforms the ring 148 inwardly against the outer conductor 50 and jacket 52 of the post 110. Due to the narrow throat geometry produced by the deformed ring 148, the outer coaxial cable 4 is axially captured by the annular barb 138 of the post 110. Furthermore, inasmuch as the annular barb 138 is electrically coupled to the outer conductor 50, an electrical ground path is created from the outer conductor 50, through the post assembly 104, to the interface port 34.

In one embodiment, the connector 100, post assembly 104, and coaxial cable 4 may be assembled as a unit, e.g., a jumper assembly, to facilitate handling and installation. In another embodiment the connector 100 includes the post assembly 104 as a pre-installed unit for connection to the coaxial cable 4. In yet other embodiments, the post assembly 104 is a separate, preassembled unit which is installed in combination with the connector 100 and the coaxial cable 4 at the time of installation, i.e., in the field Embodiments of connector 100 and post assembly 104 are described in connection with an F-type connector; however, as mentioned earlier, the connector and post assembly 100, 104 may be a BNC connector, SMA connector, N male connector, N female connector, UHF connector, DIN connectors, a push-on connector, push-on F connector, or similar coaxial cable connector that requires only an axial force to mate with the corresponding interface port 34.

In one example of the described embodiment, the connector 100 maintains a shielding effectiveness above about 90 db when the coupler 102 is axially displaced more than about 0.125 inches from a fully torque/tightened position. In such example, axial displacement of 0.125 inches corresponds to about one full revolution of a coupler 102 with a thread pitch of the same dimension. When the coupler 102 is displaced further, i.e., greater than about 0.125 inches or more than about one revolution, the post extender 112 may no longer engage the interface port 34 to produce an effective ground. That is, even though the post assembly 104 produces a large axial displacement, there are still occasions when a user may fail to make a connection between the post extender 112 and the interface port 34. Accordingly, al ground path to the interface port 34 may not produced by the coupler 102 and the post assembly 104.

While the connector 100 may be unable to provide a primary ground path across the face surfaces 41, 124 of the interface port 34 and post extender 112, respectively, a secondary ground path may be produced through the threads 38, 202 of the coupler 102 and interface port 34, respectively. More specifically, the post 110 may be configured to receive a continuity member 160 within an external circumferential groove 162 of the post 110. Furthermore, the continuity member 160 may extend from the groove 162 of the post 110 to the aft surface 164 of the coupler 102. In the described embodiment, the continuity member 160 may include a plurality of finger-like protrusions 166 which extend radially and axially from a cylindrical sleeve 168. The sleeve 168 is seated within the outwardly facing circumferential groove 162 of the post 110 to provide an electrical ground path from the post 110 to the coupler 102. Moreover, the finger-like protrusions 166 provide the requisite forward axial force to: (i) maintain contact between the coupler 102 and the post 110, and (ii) close any gaps which may exist therebetween. Consequently, the continuity member 160 provides a secondary electrical ground path, i.e., when the primary ground path may no longer exist between the post extender and the interface port 34. Moreover, the secondary ground path is provided while minimizing RF leakage between the post 110 and the coupler 102.

While the continuity member 160 above is shown as including a plurality of finger-like protrusions 166, the continuity member 160 may, alternatively, include a wave-spring having a circular opening to allow the necessary portions of the coaxial cable to pass therethrough, i.e., the inner dielectric 46 and inner conductor 44. The waver spring may be placed between the post 110 and the coupler 102 such that the crests of the spring engage a rearwardly facing surface of the coupler 102. The crests of the spring maintain the requisite forward axial force on the coupler 102 to ensure that gaps between grounding surfaces of the coupler 102 and post 110 are closed.

Still referring to FIG. 9, the coupler 102 connects to the external threads 38 of the interface port 34 by a plurality of internal threads 202 extending axially along the axis 100A. The coupler 102 includes an inwardly projecting annular lip 204 located proximate the rearward end of the coupler 102. The annular lip 204 defines a the aft surface 164 which contacts the continuity member 160 described in the preceding paragraph and a tapered internal surface 212 which opposes a tapered external surface 220 of the post 110. The tapered internal and external surfaces 216, 220 bear against each other, i.e., allowing relative rotation therebetween, when the coupler 102 engages the threads 38 of the interface port 34. As such the coupler 102 connects the post 110 to the interface port 34 and pre-compresses the biasing element 14 the coupler 102 draws the connector 100 inwardly toward the interface port 34. The pre-compression of the biasing element 114, displacement of the post extender 112 and relative position of the post assembly 104 to the interface port 34 are shown and discussed in FIGS. 13 and 14.

The structural configuration of the coupler 102 may vary according to differing connector design parameters to accommodate different functionality of the coaxial cable connector 100. Those in the art should appreciate that the coupler 102 need not be threaded. Moreover, the coupler 102 may comprise a coupler commonly used in connecting RCA-type, BNC-type connectors, N-female, wireless DIN connectors, SMA connectors, N male connectors, UHF connectors, or other common coaxial cable connectors having coupler interfaces configured to mate with a port. The coupler 102 may be formed of conductive materials, such as copper, brass, aluminum, or other metals or metal alloys, facilitating grounding through the coupler 102. In addition, the coupler 102 may be formed of both conductive and nonconductive materials. For example the external surface of the coupler 102 may be formed of a polymer, while the remainder of the coupler 102 may be comprised of a metal or other conductive material. The coupler 102 may be formed of metals or conductive polymers or other materials that would facilitate a rigidly formed coupler body.

Figure 10:
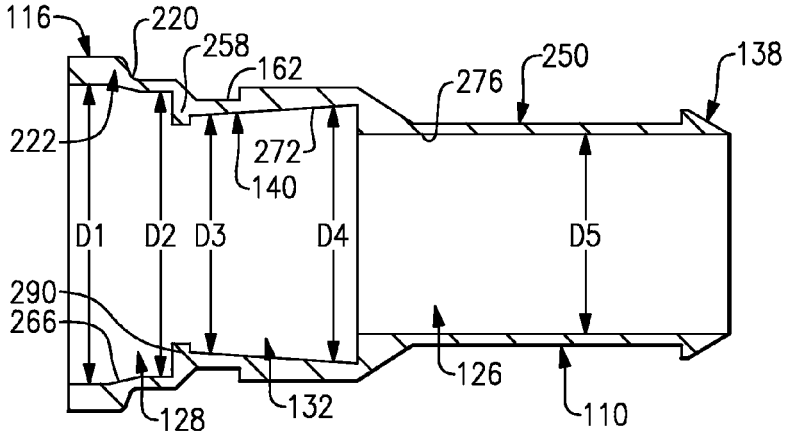
FIG. 10 depicts an cross-sectional view of one embodiment of the post in isolation to reveal the structural features thereof.

In FIG. 10, the post 110 is shown in isolation including the forward end 116, rearward end 118 and medial portion 140 disposed therebetween. The aperture 126 receives at least the inner conductor 44 of the coaxial cable. In the described embodiment, the post 110 receives the stepped portion of the coaxial cable 4 including the inner conductor 44 and the insulating dielectric core 46. Accordingly, the post 110 is configured to electrically insulate the inner conductor 44 from the outer conductor 50 by receiving the dielectric core 46 through the conductors 44 and 50 or creating an insulating void (i.e., air) therebetween,.

In FIG. 10, the post 110 includes the tapered external surface 220 along the forward end or lip 116, the outwardly facing circumferential groove 162 formed in the medial portion 140, the rearward annular barb 138, and a cylindrical sleeve 250 extending from and connecting the medial portion 140 to the annular barb 138. The tapered external surface 220 engages the tapered internal surface 216 of the coupler 106. The rearward barb 138 engages the folded end portion of the outer conductor 50 and the external circumferential groove 162 axially couples to an inwardly projecting flange 254 of the connector body 106 to the post 110. As mentioned previously, the circumferential groove 162 may also seat, or provide a retention surface for, the continuity member 160.

In addition to receiving the signal-carrying conductor 44, the aperture 126 defines the first and second cavities 128 and 132 for receiving the post extender 112 and biasing element or spring 114. The first cavity 128 is defined by and between the forward end or lip 116 of the post 110 and a first inwardly projecting lip 258. The first cavity 128 comprises a tapered inner surface 266 defined by a first inner diameter, D1, at the forward end 116 to a second inner diameter D2 proximal the inwardly projecting lip 258. The second cavity 132 is defined by and between the first inwardly projecting lip 258 and a second inwardly projecting lip 260. The second cavity comprises an inner surface 272 defined by a third diameter D3 which may be tapered to a fourth diameter D4. The third diameter D3 may be smaller or larger than the fourth diameter D4. The aperture 126 also comprises a fifth diameter D5 defining a cylindrical inner surface 276 along the inner surface of the cylindrical sleeve 250. In the described embodiment, the fifth diameter D5 is smaller than the third and fourth diameters D3, D4.

The post assembly 104 may be formed of metals or a combination of conductive and non-conductive materials. For example, a metal coating or layer may be applied to a polymer of other non-conductive material. Manufacture of the post assembly 104 may include casting, extruding, cutting, turning, drilling, knurling, injection molding, spraying, blow molding, component over-molding, or other fabrication methods that may provide efficient production of the component.

Figure 11:
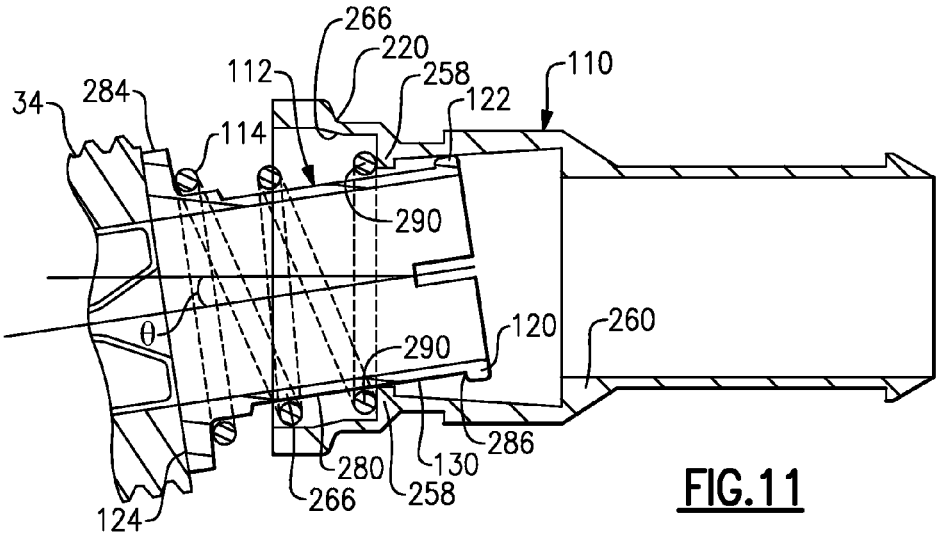
FIG. 11 depicts a schematic cross-sectional view of one embodiment of the post assembly wherein the post extender is axially and angularly displaced relative to the post.
Figure 12:
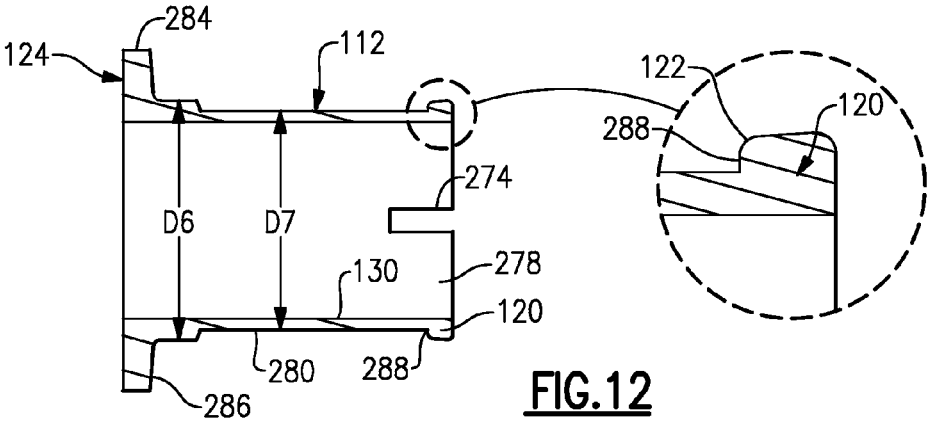
FIG. 12 depicts an isolated cross-sectional view of one embodiment of the post extender wherein an outwardly projecting protrusion of the post extender is enlarged for clarity of illustration.

In FIG. 11, a schematic view of the post assembly 104 depicts the post extender 112 following the interface port 34 as it is axially displaced from the face surface 124 of the post extender 112. Additionally, the post extender 112 is angularly misaligned relative to the elongate axis 100A of the post 110. The schematic view is exaggerated to emphasize the spatial relationship between the post 110 and post extender 112. Therein, the first and second cavities 128, 132 of the post 110 are configured to receive the post extender 112 and the biasing element 114. The tapered inner surface 266 of the first cavity 128 increases the opening dimension at the forward end 116 of the post extender 112 to facilitate a degree of misalignment between the post 110 and the post extender 112. Furthermore, the forward end 116, the external diameter of the cylindrical body 130, and the first inwardly projecting lip 258 are also configured to facilitate misalignment between the post 110 and post extender 112. In FIGS. 11 and 12, the rearward protrusions 120 have a rounded external profile 122 which when combined with the other features described above facilitate angular misalignment of up to about ten degrees (10°) relative the elongate axis 100A. Once again the illustration depicted in FIG. 11 is exaggerated for emphasis. In addition to a rounded profile 122, the rearward protrusions 120 may include a bulge, lip, flange, shoulder, or other surface that extends a distance from the arcuate edges 122 to make contact with the post 110. These shapes function to retain the extender 112 within the post 110 in an assembled position.

To further facilitate insertion and retention, the arcuate edges 122 may include one or more axial slots 274 through the cylindrical body 130 of the post extender 112. The axial slots 274 produce segments 278 which allow the edges 122 to flex inwardly as the post extender 112 may be pressed into the forward end 116 of the post 110. Furthermore, the slots 274 allow for radial compression of the arcuate edges 122 within the cavity 132 to maintain physical and electrical contact with the inner surface 272 (see FIG. 10) of the post 110. Such radial compression also has the effect of counteracting the loosening influence of vibrations and manufacturing deviations. Additionally, the segments 278 may augment the biasing force of the biasing element 114 when disposed in combination with tapered surfaces D3, D4 i.e., tapering from diameter D4 to diameter D3, which tend to move the extender 112 axially forward, i.e., toward the interface port 34.

Referring again to FIGS. 11 and 12, the biasing element 114 interposes the post 110 and the post extender 112 and circumscribes the cylindrical body 130 of the post extender 112. Further, in the described embodiment, the biasing element 114 is disposed within the first cavity 128 between the tapered inner surface 266 of the post 110 and the peripheral outer surface 280 of the post extender 112.

In the described embodiment, the biasing element 114 is a coil spring circumscribing the peripheral outer surface 280 of the post extender 112. Further, the biasing element 114 interposes a rearward facing surface 286 of the outwardly projecting forward flange 284 and a forward facing surface 288 of the first inwardly projecting lip 258 of the post 110. While the biasing element 114, e.g., the coil spring, is disposed on the outside of the post extender 112, it will be appreciated that the biasing element 114 may be disposed internally of the post extender 112 and the post extender 112 may be placed externally of the post 110. This configuration may be made possible by a telescoping cap disposed over a post 110 having a cylindrical sleeve at the forward end. The telescoping cap may have axially extending retention clips engaging the cylindrical sleeve of the post. The retention clips may translate axially along the sleeve, decompressing the spring when the cap is unloaded by the interface port 34.

Furthermore, while a spring having a coil element may be fiscally advantageous to produce, the biasing element 114 may include a wave spring disposed between the forward lip 116 of the post 110 and a post extender 112. Other embodiments include a Belleville spring, wave-spring, wave-washer, etc. To accommodate larger displacements, the springs may be stacked In the disclosed embodiment diameter D1 is greater than diameter D2 to facilitate annular misalignment of the post extender 112. Diameter D3 may be tapered to increase or decrease diameter D4 such that the rearward internal protrusions 120 may be drawn into or pushed from the second cavity. This may be required to facilitate assembly or disassembly of the post assembly. The diameter D7 defining the outer diameter of the cylindrical body 130 may be decreased to a minimum, i.e., from diameter D6, reduce the internal dimension of the post extender 112. That is, by minimizing the dimension of the post extender 112, friction may be minimized while maximizing the dimensions available to accommodate misalignment of the post extender 112 relative to the post 110.

FIG. 13 shows the coupler 102 fully tightened onto the interface port 34. Therein, the cable 4 is received by the aperture 126 of the post 110. Further, the aperture 126 receives the dielectric material 46 to support the cylindrical sleeve of the post 110 when compressed by the deformable bellows ring 148 at the forward end 150 of the compression member or fastener 108. During assembly, the coupler 102 connects to the interface port 34 by engaging the threads 38 or other axial retention device along the interface port 34. In the described embodiment, the coupler 102 threadably engages the threads 38 of the of the interface port 34. As the coupler 102 is turned or tightened, the coupler 102 draws the forward end 116 of the post 110 an a forward direction, in the direction of arrow F, toward the face surface 41 of the interface port 34. As the interface port 34 is drawn toward the post 110, the face surface 41 urges the forward face 124 of the post extender 112 in a rearward direction, in the direction of the arrow R. Further, as the post extender 112 is displaced rearwardly, the biasing element 114 is pre-compressed between the flange 284 of the post extender 112 and the inwardly projecting internal lip 258 of the post 110.

When the coupler 102 is fully tightened, an electrical ground path is produced from the outer conductor 50 of the coaxial cable 4 to the face surface 41 of the interface port 34. RF energy passes from the outer conductor 50 to a rearward end of the post 110 which, in turn, travels through the biasing element 114 and/or the post extender 112. Finally, the RF energy passes from the forward face 124 of the post extender 112 to the face or conductive region 41 of the interface port 34.

In FIG. 14, the interface port 34 is axially displaced from the post 110 by a distance $A_D$. In the described embodiment, this distance $A_D$ may correspond, for example, to between one (1) and three (3) turns/revolutions of the coupler 102. As mentioned supra, this condition may occur when the coupler 102 has loosened from a fully tightened position or when a user partially tightens, i.e., fails to fully tighten, the coupler 102 onto the interface port 34. While this geometry may typically defeat the grounding capability and degrade the RF performance of a connector, the embodiments described herein maintain a ground path by the telescopic motion of the post extender 112 relative to the post 110. Further, RF performance may be preserved by the introduction of a continuity member 160 between the post 110 and the coupler 102.

With respect to the former, the spring or biasing element 114 causes the post extender 112 to move outwardly, toward the face surface 41 of the interface port 34, as the interface port 34 is displaced axially along, and/or angularly relative to, the elongate axis 100A. The biasing element 114 is pre-compressed by the coupler 102, allowing the post extender 112 to follow the face surface 41 of the interface port 34. With respect to the latter, the continuity member 160 urges the coupler 102 forwardly to close any axial gaps between the coupler 102 and the post 110. That is, the continuity member 160 produces the requisite radial and axial forces on the coupler 102 to close axial gaps which may develop as a consequence of the coupler 102 backing-away, and/or loosening, from the post assembly 104. It is for these reasons that a ground path is maintained and the RF performance is acceptable. That is, a ground path is maintained and RF performance remains above 90 dBa despite the coupler 102 being displaced axially by as many as three full turns/revolutions.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A coaxial cable connector comprising:

a post having an aperture defining an elongate axis and configured to be electrically coupled to an outer conductor of a coaxial cable to produce an electrical ground path, the post comprising a forward end configured to face a forward direction toward an interface port, a rearward end configured to face a rearward direction opposite of the forward direction, an external forward lip proximal to the forward end, an annular barb proximal to the rearward end, and an external circumferential groove located between the forward and rearward ends, the aperture of the post furthermore defining a first annular cavity extending from the forward end to a first inwardly projecting lip, and a second annular cavity extending from the first inwardly projecting lip to a second inwardly projecting lip;

a post extender electrically coupled to the post and having a forward face configured to electrically engage the interface port, the post extender received within at least a portion of the aperture, the post extender having a cylindrical body disposed between an outwardly projecting forward flange and an outwardly projecting rearward protrusion, the outwardly projecting forward flange defining a forward facing contact surface, the rearward protrusion engaging the second inwardly projecting lip of the post to axially retain the post extender within the post, the rearward protrusion being segmented by a plurality of axial slots to facilitate radial displacement of the rearward protrusion during assembly of post extender within the second annular cavity;

a biasing member interposing the post and the post extender and configured to urge the post extender axially toward the interface port to maintain electrical contact with the interface port irrespective a relative displacement between the interface port and the post, the biasing member comprising a coil spring disposed over the cylindrical body and interposing a rearward facing surface of the outwardly projecting forward flange and a forward facing surface of the first inwardly projecting lip of the post;

a coupler operative to couple the post to an interface port and move the post extender toward the interface port to compress the coil spring such that, during axial and/or angular displacement of the post relative to the elongate axis, the post extender maintains contact and electrical continuity with the interface port, the coupler having an inwardly projecting annular lip engaging an outwardly projecting annular lip of the post to urge the post toward interface port, cause a conductive region of the interface port to engage the forward facing contact surface of the post extender, and compress coil spring; and a connector body defining a central bore configured to receive at least a portion of the post and having an inwardly projecting flange engaging the external circumferential groove of the post, the connector body and external surface of the post defining an annular cavity for receiving a prepared end of the coaxial cable; and a compression member received within the central bore of the connector body and having a collapsible bellows disposed axially forward of the rearward end of the post, the compression member configured to be pushed axially into the central bore to collapse the collapsible bellows radially inward over the prepared end of the coaxial cable so that an elastomeric jacket thereof is radially compressed against the post, the radial compression of the elastomeric jacket effecting frictional engagement of the coaxial cable with the post, wherein the post extender is configured to cooperate with the biasing member to maintain an electrical ground path from the post to the interface port independent of any axial separation between the post and the interface port and independent of any angular articulation of the post extender relative to the post.

2. The coaxial cable connector of claim 1, wherein an inner surface of the first annular cavity tapers from a first diameter proximal to the forward end to a smaller diameter proximal the first inwardly projecting lip.

3. The coaxial cable connector of claim 1, further comprising an electrical continuity member configured to be received by the post and extend to an aft surface of the coupler.

4. The coaxial cable connector of claim 3, wherein the electrical continuity member is configured to produce an axial force for closing axial gaps between the coupler and the post.

5. A post assembly for a coaxial cable connector, the post assembly comprising:

a post configured to be coupled to a conductor of a coaxial cable the post extending along an axis;

a post extender configured to be disposed between the post and an interface port, the post extender configured to move axially along the axis relative to the post; and a spring configured to urge the post extender toward the interface port, wherein the post extender is configured to cooperate with the spring to maintain an electrical ground path from the post to the interface port independent of any axial separation between the post and the interface port and independent of any angular articulation of the post extender relative to the post.

6. The post assembly of claim 5, wherein the post extender articulates angularly relative to the elongate axis.

7. The post assembly of claim 5, wherein the post defines a cavity and wherein at least a portion of the post extender is disposed within the cavity.

8. The post assembly of claim 7, wherein the post extender includes the cylindrical body having a forward facing flange defining a rearwardly facing abutment surface, wherein the cavity of the post includes a forwardly facing abutment surface and wherein the biasing member is a coil spring disposed over the cylindrical body of the post extender and between the forwardly facing and rearwardly facing abutment surfaces of the post extender and cavity.

9. The post assembly of claim 5, wherein within the post includes a first and second cavities separated by an inwardly projecting lip, and wherein the post extender includes an outwardly projecting rearward protrusion engaging the inwardly projecting lip to retain the post extender relative to the post.

10. The post assembly of claim 9, wherein the rearward protrusion is rounded to facilitate articulation of the post extender relative to the elongate axis.

11. The post assembly of claim 9, wherein the first cavity defines a forward end, a first inwardly projecting lip, and a tapered internal surface therebetween, wherein the tapered internal surface defines a first diameter proximal the forward end and a second diameter proximal the first inwardly projecting lip, and wherein the first diameter is larger than the second diameter to accommodate angular articulation of the post extender relative to the post.

12. The post assembly of claim 9, wherein the rearward protrusion is segmented to facilitate flexure of the rearward protrusion during assembly of post extender.

13. The post assembly of claim 12, wherein the second cavity includes a tapered internal surface tending to bias the post extender forwardly toward the interface port.

14. A post assembly for a coaxial cable connector, the post assembly comprising:

a post comprising a forward end defining a cavity and a rearward end, the post configured to be coupled to a conductor of a coaxial cable at the rearward end to produce an electrical ground path therebetween and configured to be coupled to an interface port at the forward end, the post extending along an elongate axis;

a post extender configured to be (i) at least partially received within the cavity, (ii) electrically connected to the post at a rearward end, and (iii) electrically engaged with the interface port at a forward end, the post extender configured to move axially along the elongate axis relative to the post; and a spring configured to move the post extender toward the interface port so as to maintain the electrical ground path from the post extender to the interface port independent of axial separation of the post extender relative to the post and independent of any angular articulation of the post extender relative to the post.

15. The post assembly of claim 14, wherein the post extender is configured to articulate angularly relative to the elongate axis while the electrical ground path is maintained.

16. The post assembly of claim 14, wherein within the post includes first and second cavities separated by an inwardly projecting lip, and wherein the post extender includes an outwardly projecting rearward protrusion configured to engage the inwardly projecting lip to retain the post extender relative to the post.

17. The post assembly of claim 16, wherein the rearward protrusion is rounded to facilitate articulation of the post extender relative to the elongate axis.

18. The post assembly of claim 16, wherein the first cavity defines a forward end, a first inwardly projecting lip, and a tapered internal surface therebetween, wherein the tapered internal surface defines a first diameter proximal the forward end and a second diameter proximal the first inwardly projecting lip, and wherein the first diameter is larger than the second diameter to accommodate angular articulation of the post extender relative to the post.

19. The post assembly of claim 16, wherein the rearward protrusion is segmented to facilitate flexure of the rearward protrusion during assembly of post extender.

20. The post assembly of claim 19, wherein the second cavity includes a tapered internal surface tending to bias the post extender forwardly toward the interface port.

* * * * *